US007455624B2

(12) United States Patent
Liao Lai

(10) Patent No.: US 7,455,624 B2
(45) Date of Patent: Nov. 25, 2008

(54) LOW-IMPACT EXERCISE MACHINE

(76) Inventor: Shu-Chiung Liao Lai, No. 437, Dasheng St., Nantun District, Taichung (TW)

( * ) Notice: Subject to any disclaimer, the term of this patent is extended or adjusted under 35 U.S.C. 154(b) by 0 days.

(21) Appl. No.: 11/678,234

(22) Filed: Feb. 23, 2007

(65) Prior Publication Data

US 2008/0207400 A1 Aug. 28, 2008

(51) Int. Cl.
*A63B 22/04* (2006.01)

(52) U.S. Cl. ..... 482/52; 482/51; 482/57

(58) Field of Classification Search ..... 482/52–54, 482/58, 63–65, 70–71, 57
See application file for complete search history.

(56) References Cited

U.S. PATENT DOCUMENTS 5,755,643 A * 5/1998 Sands et al. ..... 482/57
5,792,026 A * 8/1998 Maresh et al. ..... 482/51
5,823,917 A * 10/1998 Chen ..... 482/57
5,846,166 A * 12/1998 Kuo ..... 482/52
5,893,820 A * 4/1999 Maresh et al. ..... 482/51
5,899,833 A * 5/1999 Ryan et al. ..... 482/52
5,957,814 A * 9/1999 Eschenbach ..... 482/51
5,989,159 A * 11/1999 Chen et al. ..... 482/52
5,993,359 A * 11/1999 Eschenbach ..... 482/57
6,019,710 A * 2/2000 Dalebout et al. ..... 482/70
6,063,009 A * 5/2000 Stearns et al. ..... 482/52
6,077,196 A * 6/2000 Eschenbach ..... 482/51
6,077,198 A * 6/2000 Eschenbach ..... 482/52
6,099,439 A * 8/2000 Ryan et al. ..... 482/51
6,171,217 B1 * 1/2001 Cutler ..... 482/57
6,196,948 B1 * 3/2001 Stearns et al. ..... 482/52
6,210,305 B1 * 4/2001 Eschenbach ..... 482/52
6,248,044 B1 * 6/2001 Stearns et al. ..... 482/52
6,277,056 B1 * 8/2001 McBride et al. ..... 482/57
6,454,682 B1 * 9/2002 Kuo ..... 482/52
6,645,125 B1 * 11/2003 Stearns et al. ..... 482/52
6,648,801 B2 * 11/2003 Stearns et al. ..... 482/52
6,672,992 B1 * 1/2004 Lo et al. ..... 482/52
6,719,665 B1 * 4/2004 Lai ..... 482/52
6,719,666 B1 * 4/2004 Lo et al. ..... 482/52
6,758,790 B1 * 7/2004 Ellis ..... 482/52
6,994,657 B1 * 2/2006 Eschenbach ..... 482/52
7,022,049 B2 * 4/2006 Ryan et al. ..... 482/51
7,037,242 B2 * 5/2006 Lo et al. ..... 482/52
7,041,036 B1 * 5/2006 Kuo ..... 482/52
7,104,929 B1 * 9/2006 Eschenbach ..... 482/52
7,166,067 B2 * 1/2007 Talish et al. ..... 482/148
7,223,209 B2 * 5/2007 Lee ..... 482/52

(Continued)

*Primary Examiner*—LoAn H. Thanh
*Assistant Examiner*—Daniel F Roland
(74) *Attorney, Agent, or Firm*—Pai Patent & Trademark Law Firm; Chao-Chang David Pai

(57) ABSTRACT

A low-impact exercise machine has a support device, a rotating device, a drive assembly and a handle assembly. The support device has a base, a pivot pin, a frame bracket, a supporting beam and two slideways. The rotating device is mounted rotatably with the support device and has a pivot post, a rotating panel and two rotating arms. The drive assembly is connected to the support device and the rotating device and has two driven segments. Each driven segment has a linking arm, two lateral beams, an operating shaft, a mounting bracket, a connecting stick and a transmitting shaft. The handle assembly is connected to the drive assembly with two handles.

8 Claims, 8 Drawing Sheets

U.S. PATENT DOCUMENTS

2002/0028731 A1* 3/2002 Stearns et al. ..... 482/52
2003/0236152 A1* 12/2003 Lo et al. ..... 482/52
2004/0005960 A1* 1/2004 Chang ..... 482/52
2004/0043871 A1* 3/2004 Chang ..... 482/52
2004/0053748 A1* 3/2004 Lo et al. ..... 482/52
2004/0097340 A1* 5/2004 Liao et al. ..... 482/52
2004/0235622 A1* 11/2004 Eschenbach ..... 482/52
2004/0248705 A1* 12/2004 Rodgers ..... 482/83
2005/0181911 A1* 8/2005 Porth ..... 482/52
2006/0003868 A1* 1/2006 Lull et al. ..... 482/52
2006/0040795 A1* 2/2006 Eschenbach ..... 482/52
2006/0281604 A1* 12/2006 Stewart et al. ..... 482/51
2007/0032348 A1* 2/2007 Hong ..... 482/52
2007/0042871 A1* 2/2007 Wu et al. ..... 482/52
2007/0060449 A1* 3/2007 Lo ..... 482/52
2007/0060450 A1* 3/2007 Lo ..... 482/52
2007/0072742 A1* 3/2007 Chen ..... 482/52
2007/0087906 A1* 4/2007 Rodgers ..... 482/52
2007/0117683 A1* 5/2007 Ercanbrack et al. ..... 482/52
2007/0117685 A1* 5/2007 Liao et al. ..... 482/52
2007/0232457 A1* 10/2007 Porth ..... 482/51

* cited by examiner

LOW-IMPACT EXERCISE MACHINE

BACKGROUND OF THE INVENTION

1. Field of the Invention

The present invention relates to an exercise machine, and more particularly to a low-impact exercise machine that provides an oscillating motion similar to cross-country skiing to improve a person's hand and foot coordination and to build strength and endurance.

2. Description of Related Art

Numerous exercise machines are currently available and include exercise bikes, treadmills, rowing machines and surfing exercisers. Conventional exercise machines simulate exercise activities and are used to exercise and train a person's muscles.

However, conventional exercise machines have some shortcomings.

1. Conventional exercise machines only have a single operation function, and only some of a person's muscles can be exercised, which limits the versatility of the conventional exercise machine.

2. Operation of the conventional exercise machine usually involves a single movement, which causes a user to become bored quickly.

The invention provides a low-impact exercise machine that mitigates or obviates the aforementioned problems.

SUMMARY OF THE INVENTION

The main objective of the present invention is to provide a low-impact exercise machine that very closely replicates cross-country skiing, simultaneously improves coordination between a person's hands and feet and builds both strength and endurance.

The low-impact exercise machine has a support device, a rotating device, a drive assembly and a handle assembly. The support device has a base, a pivot pin, a frame bracket, a supporting beam and two slideways. The rotating device is mounted rotatably with the support device and has a pivot post, a rotating panel and two rotating arms. The drive assembly is connected to the support device and the rotating device and has two driven segments. Each driven segment has a linking arm, two lateral beams, an operating shaft, a mounting bracket, a connecting stick and a transmitting shaft. The handle assembly is connected to the drive assembly with two handles.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
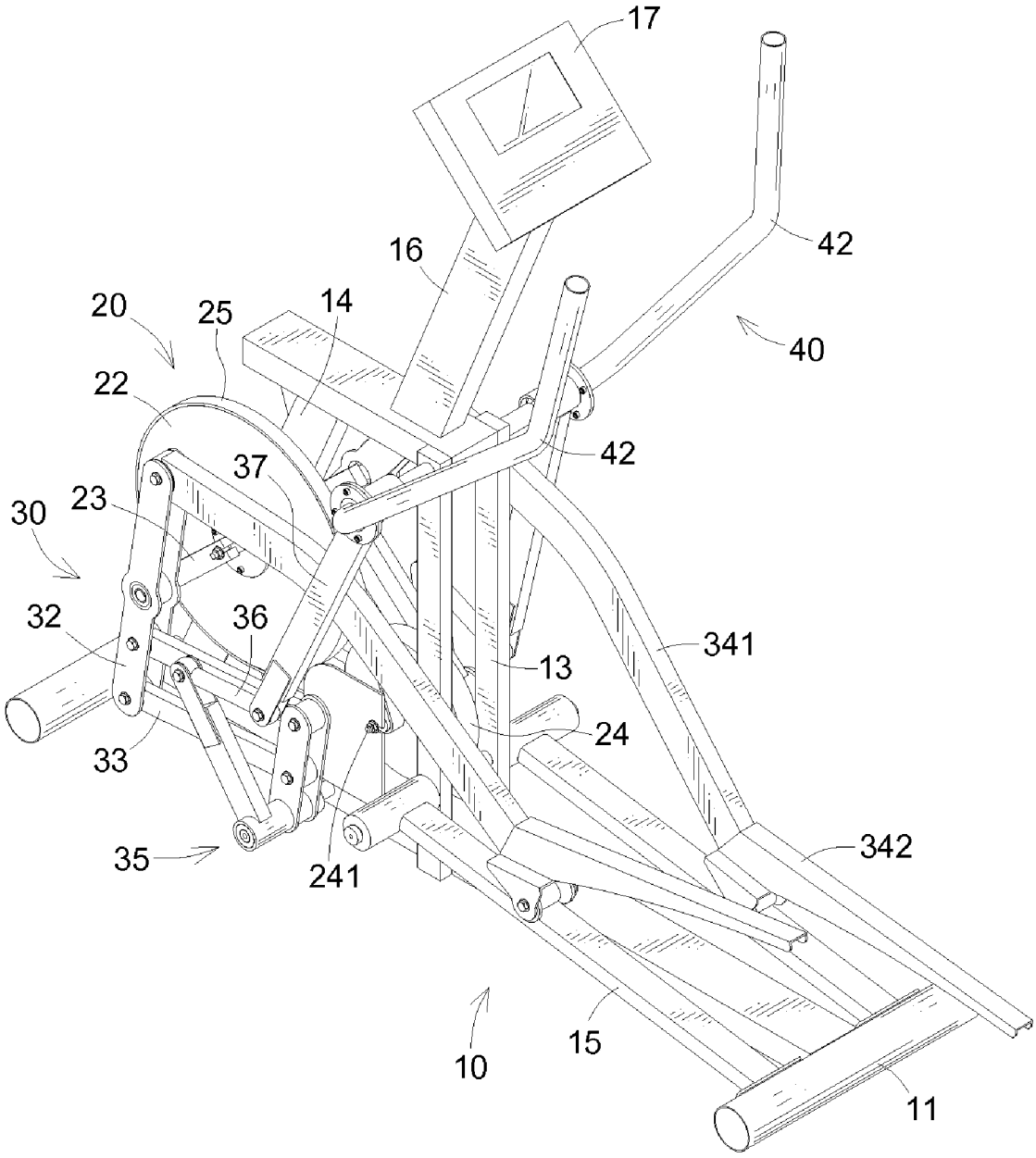
FIG. 1 is a perspective view of a low-impact exercise machine in accordance with the present invention.

With reference to FIG. 1, a low-impact exercise machine comprises a support device (10), a rotating device (20), a drive assembly (30) and a handle assembly (40).

Figure 2:
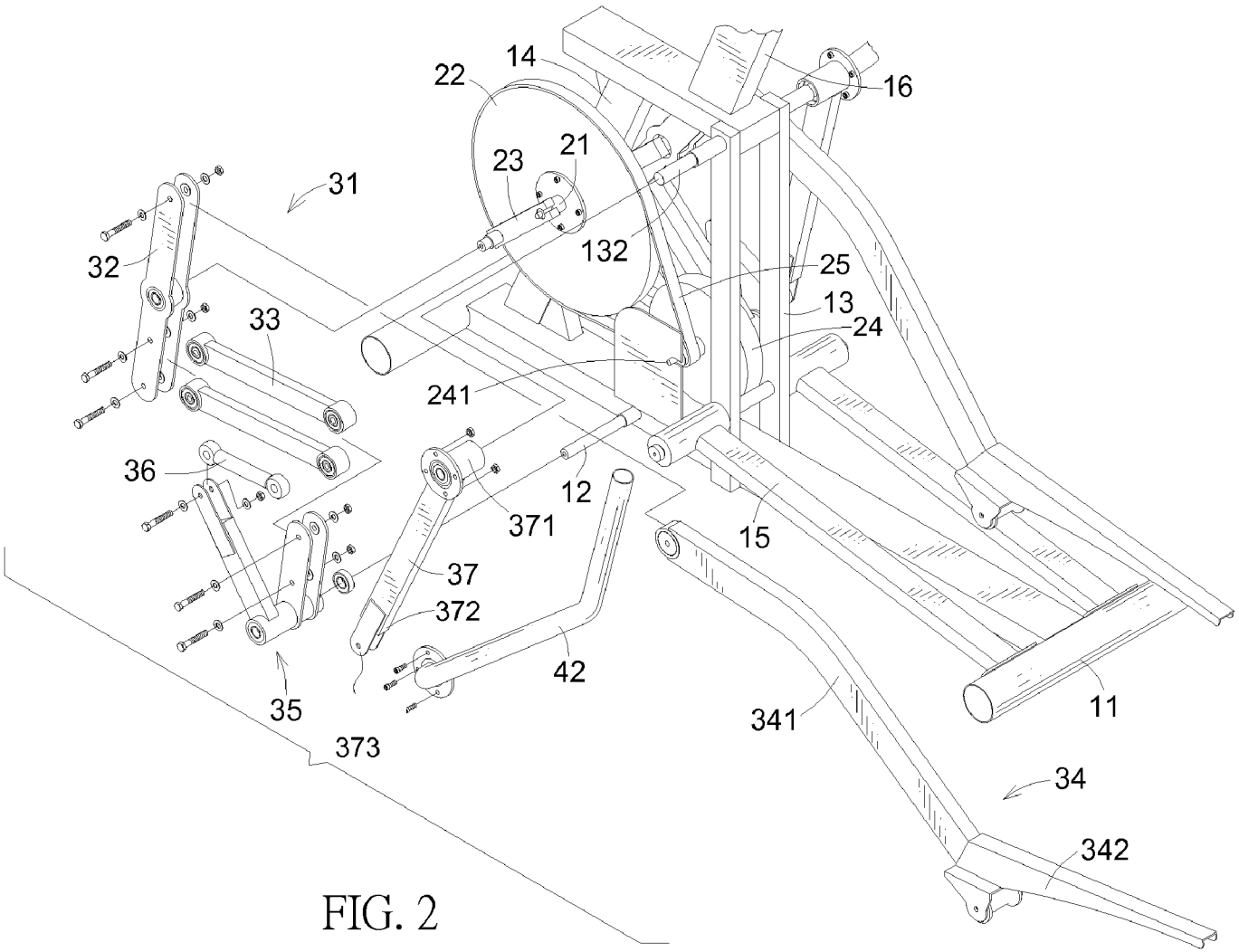
FIG. 2 is an exploded perspective view of the low-impact exercise machine in FIG. 1.

With further reference to FIG. 2, the support device (10) comprises a base (11), a pivot pin (12), a frame bracket (13), a supporting beam (14), two slideways (15), an extending arm (16) and an instrument panel (17). The base (11) is I-shaped and has a top, a front end, a middle and a rear end. The pivot pin (12) is connected transversely to the base (11) between the front end and the middle with two ends. The frame bracket (13) is L-shaped, is mounted over the top of the base (11) near the middle and has an upper end, a turning point, a top and two mounting posts (132). The mounting posts (132) are formed respectively on the turning point of the frame bracket (13) and parallel to the pivot pin (12) over the base (11). The supporting beam (14) is connected obliquely to the upper end of the frame bracket (13) and the front end of the base (11). The slideways (15) are respectively connected obliquely to the frame bracket (13) and the rear end of the base (11) opposite the supporting beam (14). The extending arm (16) is mounted on the top of the frame bracket (13) near the turning point and has a top end. The instrument panel (17) is connected to the top end of the extending arm (16).

Figure 3:
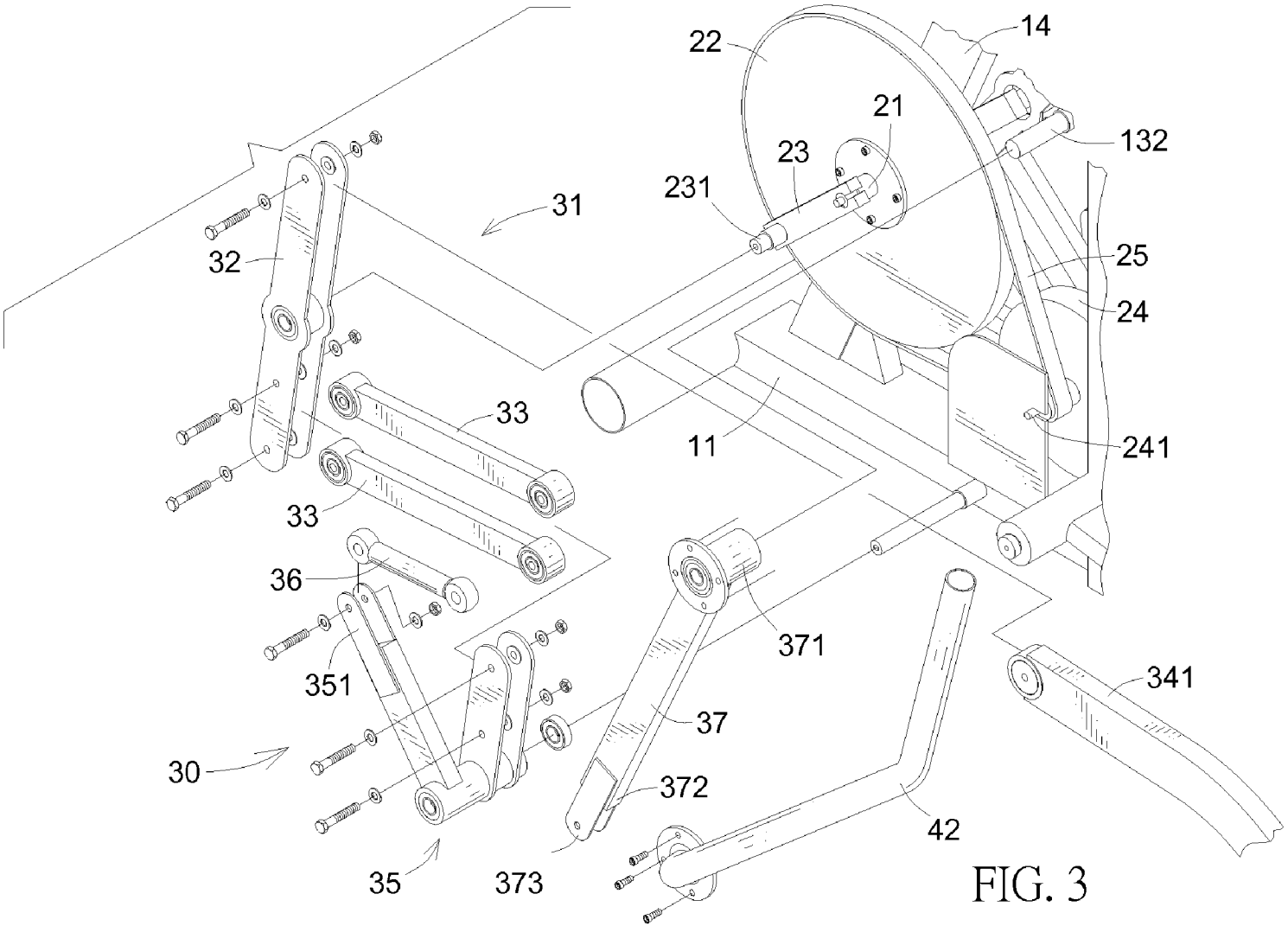
FIG. 3 is an enlarged exploded perspective view of the low-impact exercise machine in FIG. 2.

With further reference to FIG. 3, the rotating device (20) is mounted rotatably with the support device (10) and has a pivot post (21), a rotating panel (22), a transmitting dish (24), a belt (25) and two rotating arms (23). The pivot post (21) is extended rotatably through the supporting beam (14) between the frame bracket (13) and the base (11) and has two ends. The rotating panel (22) is connected securely to the pivot post (21) beside the supporting beam (14) and has a periphery. The transmitting dish 24 rotatably mounted on the base (11) of the support device (10) between the frame bracket (13) and the rotating panel (22) and has a center and a mounting shaft (241). The mounting shaft (241) is extended through the center of the transmitting dish (24) and is rotatably connected to the base (11). The belt 25 is mounted around the periphery of the rotating panel (22) and the mounting shaft (241) of the transmitting dish (24). The rotating arms (23) are respectively and securely mounted around the ends of the pivot post (21) and each rotating arm (23) has a mounting rod (231). The mounting rod (231) is formed on the rotating arm (23) opposite the pivot post (21). When the rotating panel (22) is rotated by one of the rotating arms (23), the other one rotating arm (23) is rotated with the rotating panel (22) and the transmitting dish is rotated by the belt (25).

Figure 4:
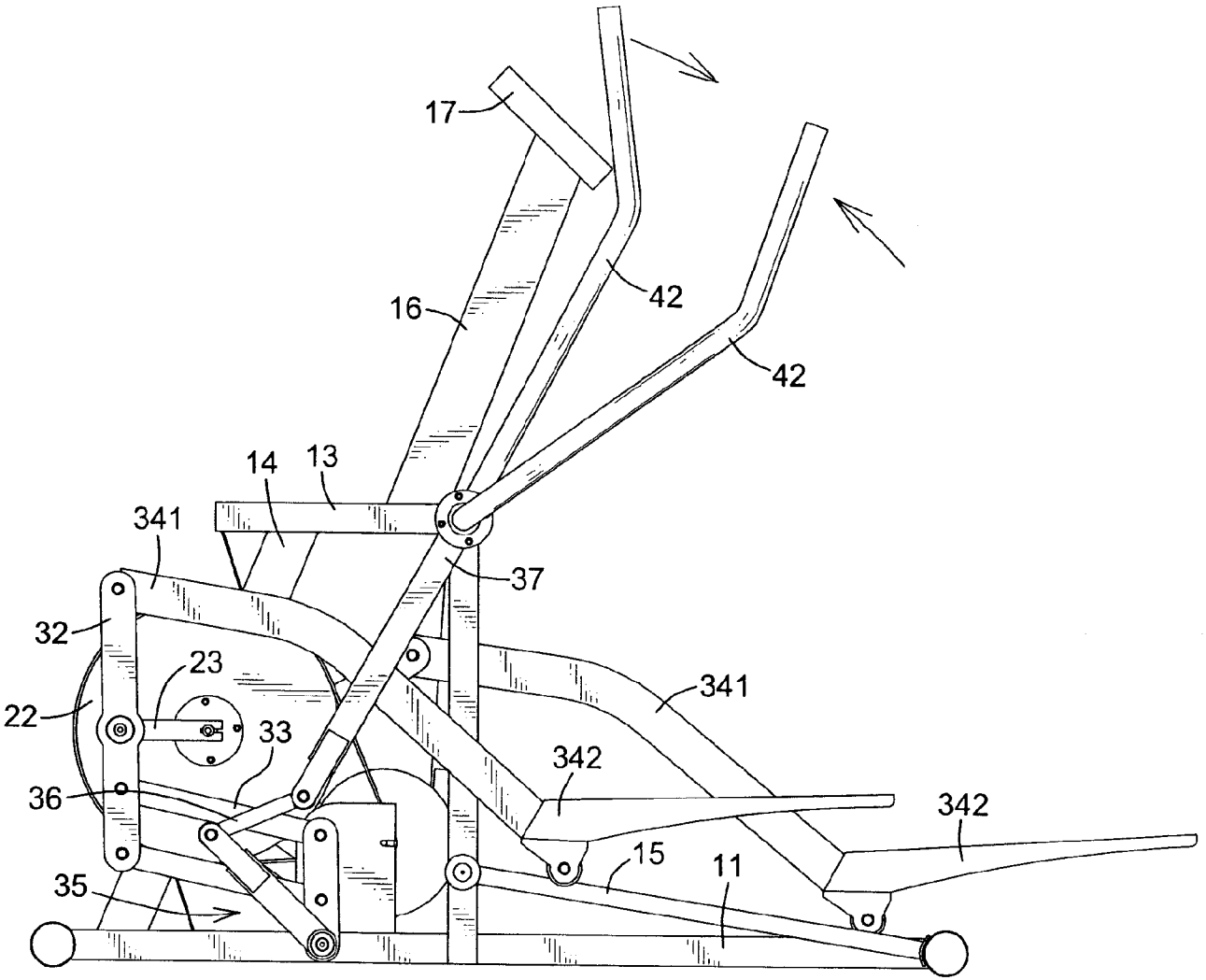
FIGS. 4 to 7 are operational side views of the low-impact exercise machine in FIG. 1.
Figure 5:
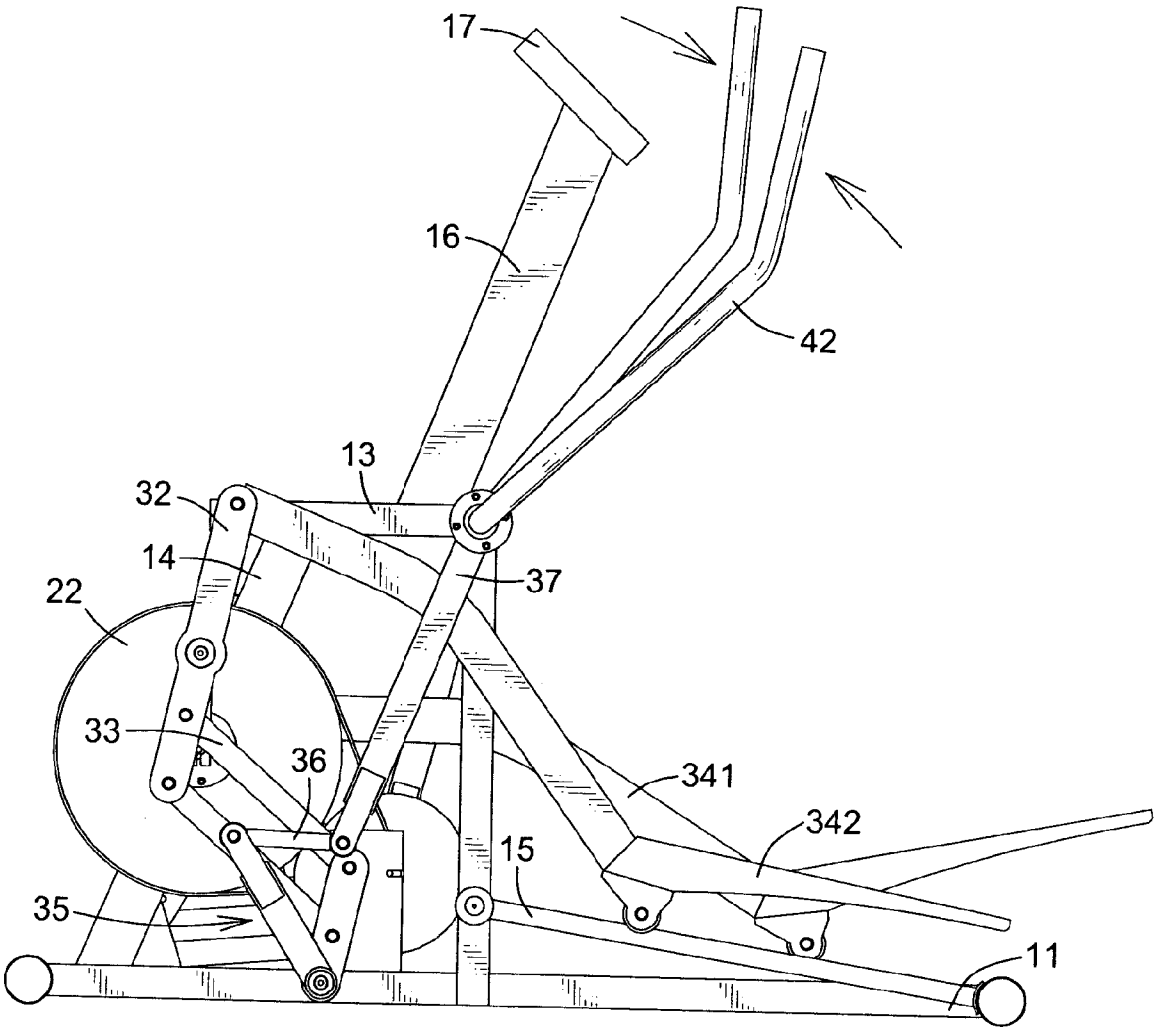
Figure 6:
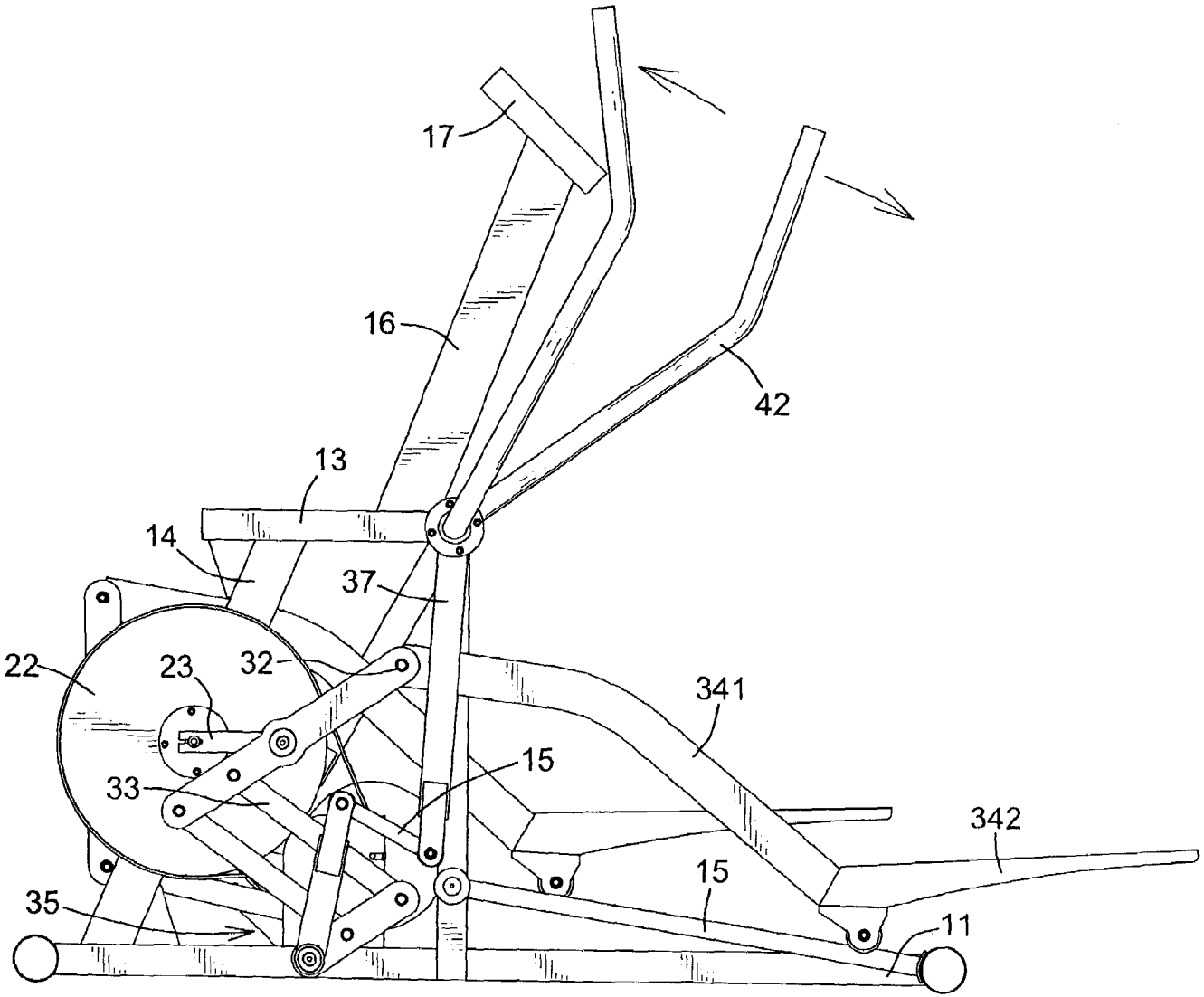
Figure 7:
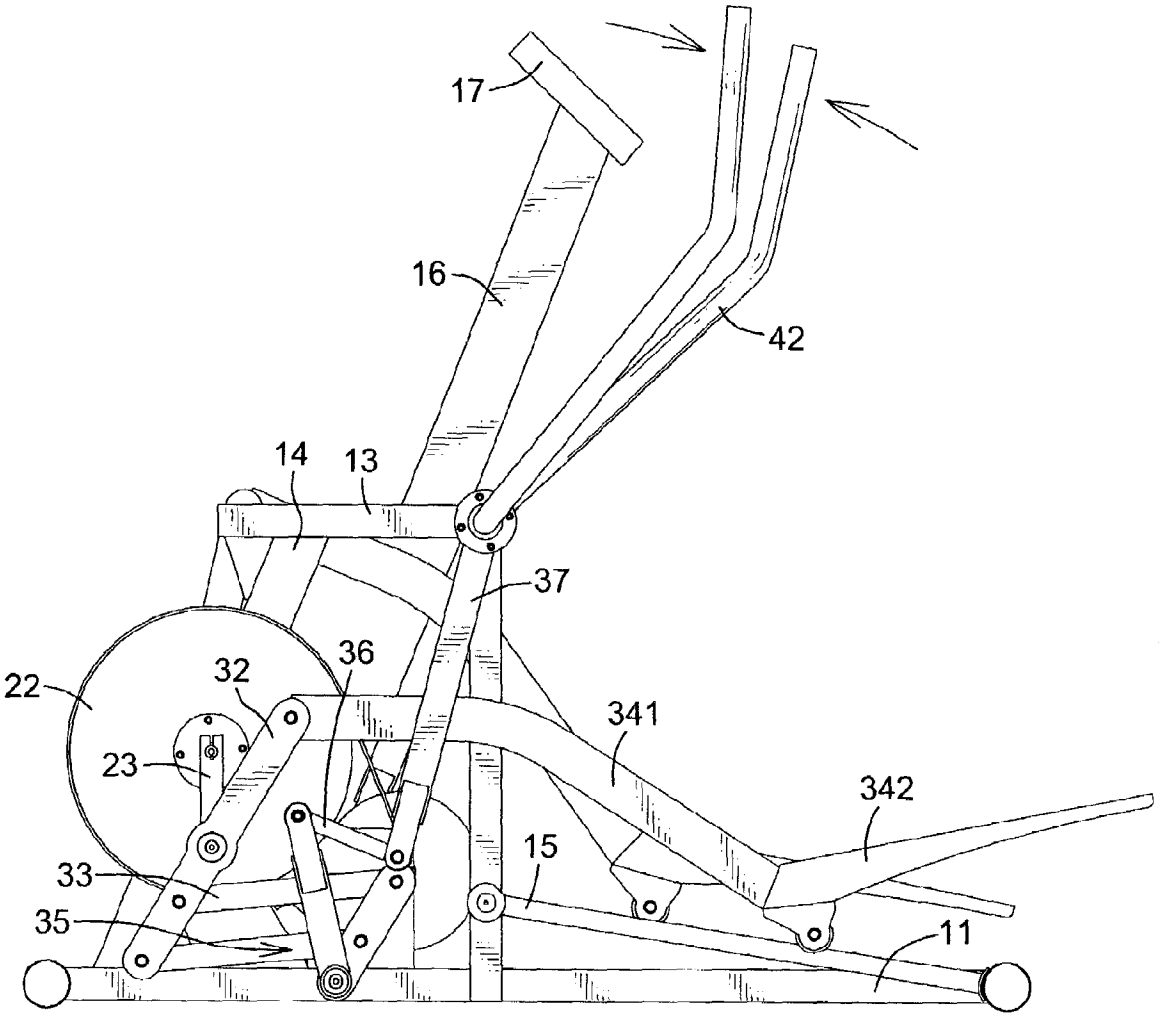

With further reference to FIGS. 3 and 4, the drive assembly (30) is connected to the support device (10) and the rotating device (20) and has two driven segments (31). The driven segments (31) are respectively connected to the rotating arms (23) of the rotating device (20), the mounting post (132) of the frame bracket (13), the pivot pin (12) and the slideways (15) of the base (10). Each driven segment (31) has a linking arm (32), two lateral beams (33), an operating shaft (34), a mounting bracket (35), a connecting stick (36) and a transmitting shaft (37). The linking arm (32) is attached to a corresponding rotating arm (23) and has a middle, a top end and a bottom end. The middle of the linking arm (32) is mounted around the mounting rod (231) of the corresponding rotating arm (23). The lateral beams (33) are respectively connected to the linking arm (32) near the bottom end and are parallel to each other. Each lateral beam (33) has a proximal end and a distal end. The proximal end of the lateral beam (33) is connected to the linking arm (32). The operating shaft (34) is connected to the linking arm (32), is contacted moveably on a corresponding slideway (15) and has an extending shaft (341) and a pedal (342). The extending shaft (341) is attached to the top end of the linking arm (32). The pedal (342) is connected to the extending shaft (341) opposite to the linking arm (32) and contacts slidably with the corresponding slideway (15) of the support device (10). Then, users can put the feet on the pedals (342) of the operating shafts (34) to push the linking arm (32) and rotate the rotating panel (22). With reference to *Fig.*5, a user can put the feet on the pedals (342) of the operating shafts (34) and stamps down one of the pedals (342), the extending shaft (341) will pull a corresponding linking arm (32), a corresponding rotating arm (23) and the rotating panel (22) to rotate in a clockwise direction. Furthermore, when the rotating panel (22) is rotated by the linking arm (32) in a clockwise direction, the other linking arm (32) and the corresponding pedal (342) will be moved forward along the corresponding slideway (15) by the rotating panel (22). The mounting bracket (35) is V-shaped, is connected to the lateral beams (33), is mounted rotatably around one of the ends of the pivot pin (12) of the support device (10) and has a first end, a second end and two wings (351). The first end of the mounting bracket (35) is connected to the distal ends of the lateral beams (33). The wings (351) are formed on the second end of the mounting bracket (35). When the rotating panel (22) rotating in a clockwise direction, a corresponding mounting bracket (35) will be rotated by the corresponding lateral beams (33) as shown in FIGS. 6 and 7. The connecting stick (36) is connected to the mounting bracket (35) and has a front end and a rear end. The front end of the connecting stick (36) is connected to the wings (351) of the mounting bracket (35). The transmitting shaft (37) is connected to the connecting stick (36) and the frame bracket (13) and has a connecting end (372) and a mounting end (371).The connecting end (372) of the transmitting shaft (37) is connected to the rear end of the connecting stick (36) with two mounting slices (373). The mounting end (371) is mounted around the mounting post (132) of the frame bracket (13). When the mounting bracket (35) is rotated by the lateral beams (33), a corresponding connecting stick (36) will push the corresponding transmitting shaft (37) to rotate in a counterclockwise direction.

Figure 8:
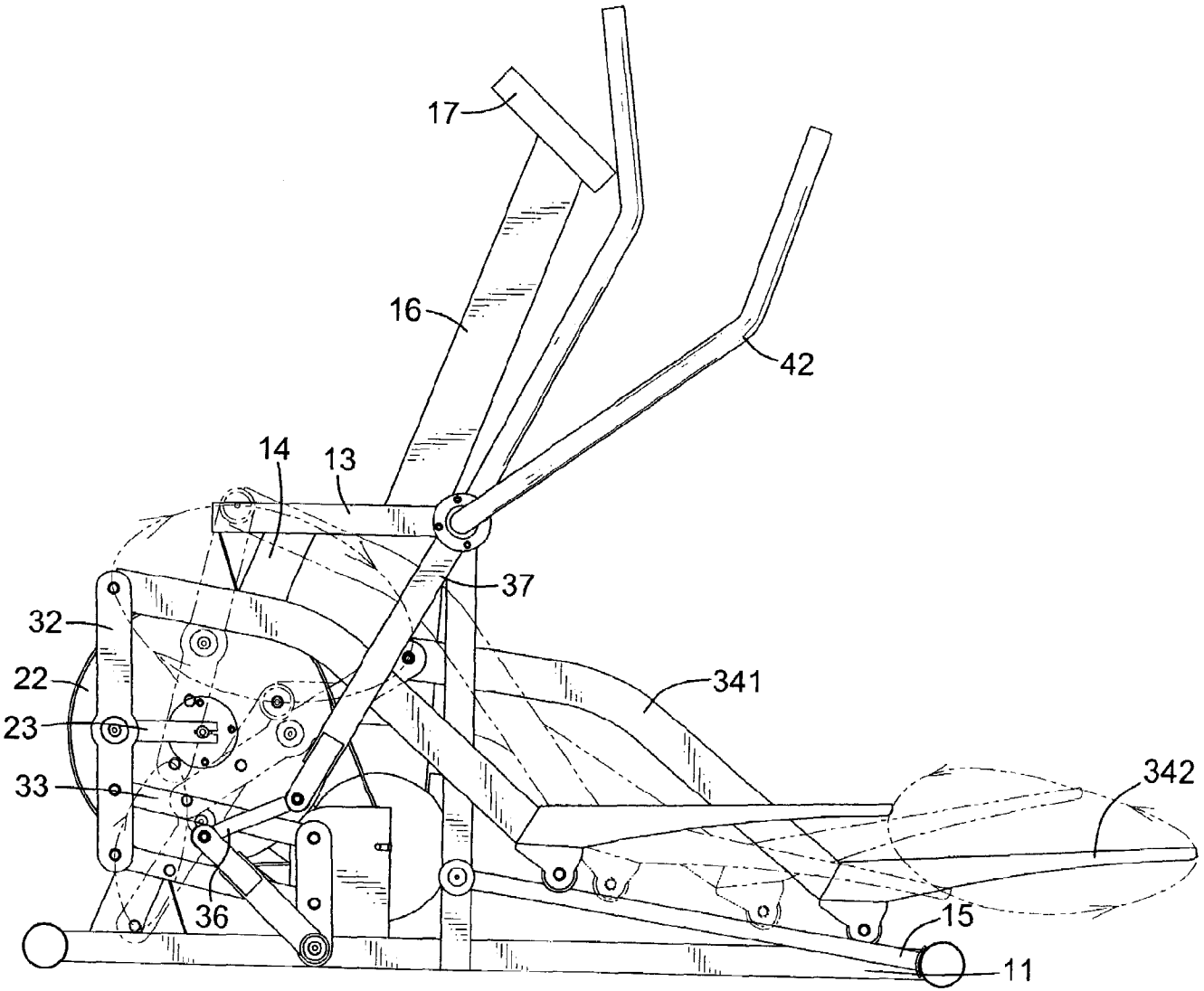
FIG. 8 is an operational side view of the low-impact exercise machine in FIG. 1.

The handle assembly (40) is connected to the drive assembly (30) and has two handles (42). The handles (42) are connected respectively to the mounting ends (371) of the transmitting shafts (37). Then, users can stand on the pedals (342) of the operating shafts (34) and hold the handles (42). With reference to FIG. 8, the drive assembly (30) of the low-impact exercise machine will rotate repeatedly as an elliptic locus. Consequently, users can operate the low-impact exercise machine at a standing position to improve a person's hand and foot coordination and to build strength and endurance.

The low-impact exercise machine as described has the following advantages:

1. The low-impact exercise machine has a drive assembly (30), so user can operate the low-impact exercise machine to train the feet, the hands and the whole body at the same time versatile in use.

2. In addition, the operation of the exercised machine is easy and interesting, and user will feel exciting and interesting in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A low-impact exercise machine having a support device having a base having a top;

a front end;

a middle; and a rear end;

a pivot pin being connected transversely to the base near the front end;

a frame bracket being mounted over the top of the base near the middle and having an upper end;

a turning point;

a top; and two mounting posts being formed respectively on the turning point of the frame bracket and parallel to the pivot pin over the base;

a supporting beam being connected obliquely to the frame bracket and the base between the upper end and the front end; and two slideways being respectively connected obliquely to the frame bracket and the rear end of the base opposite the supporting beam;

a rotating device being mounted rotatably with the support device and having a pivot post being extended rotatably through the supporting beam between the frame bracket and the base and having two ends;

a rotating panel being connected securely to the pivot post beside the supporting beam and having a periphery;

a transmitting dish being rotatably mounted on the base of the support device between the frame bracket and the rotating panel and having a center; and a mounting shaft being extended through the center of the transmitting dish, being rotatably connected to the base;

a belt being mounted around the periphery of the rotating panel and the mounting shaft of the transmitting dish; and two rotating arms being respectively and securely mounted around the ends of the pivot post and each rotating arm having a mounting rod formed on the rotating arm opposite the pivot post;

a drive assembly being connected to the rotating arms of the rotating device, the mounting post of the frame bracket, the pivot pin and the slideways of the base and having two driven segments, each driven segment having a linking arm being attached to a corresponding rotating arm and having a middle being mounted around the mounting rod of the corresponding rotating arm;

a top end; and a bottom end;

two lateral beams being respectively connected to the linking arm near the bottom end and parallel to each other and each lateral beam having a proximal end being connected to the linking arm; and a distal end;

an operating shaft being connected to the linking arm, contacting moveably with a corresponding slideway;

a mounting bracket being V-shaped, being connected to the lateral beams and the pivot pin of the support device and having a first end being connected to the distal ends of the lateral beams;

a second end; and two wings being formed on the second end of the mounting bracket;

a connecting stick being connected securely to the mounting bracket and having a front end being connected to the wings of the mounting bracket; and a rear end; and a transmitting shaft being connected to the connecting stick and the mounting post of the frame bracket; and a handle assembly being connected to the drive assembly and having two handles.

2. The low-impact exercise machine as claimed in claim 1, wherein the support device has an extending arm being mounted on the top of the frame bracket near the turning point and having a top end; and an instrument panel being connected to the top end of the extending arm.

3. The low-impact exercise machine as claimed in claim 1, wherein the base is I-shaped and the frame bracket is L-shaped.

4. The low-impact exercise machine as claimed in claim 1, wherein each transmitting shaft has a connecting end being connected to the rear end of a corresponding connecting stick and having two mounting slices and a mounting end being mounted around one of the mounting posts of the frame bracket.

5. The low-impact exercise machine as claimed in claim 1, wherein each operating shaft has an extending shaft being attached to the top end of a corresponding linking arm; and a pedal being connected to the extending shaft opposite to the linking arm, contacting slidably with the corresponding slideway of the support device.

6. The low-impact exercise machine as claimed in claim 4, wherein each operating shaft has an extending shaft being attached to the top end of a corresponding linking arm; and a pedal being connected to the extending shaft opposite to the linking arm, contacting slidably with the corresponding slideway of the support device.

7. The low-impact exercise machine as claimed in claim 6, wherein the support device has an extending arm being mounted on the top of the frame bracket near the turning point and having a top end; and an instrument panel being connected to the top end of the extending arm.

8. The low-impact exercise machine as claimed in claim 7, wherein the base is I-shaped and the frame bracket is L-shaped.

* * * * *